US009033654B2

(12) United States Patent
Peck et al.

(10) Patent No.: US 9,033,654 B2
(45) Date of Patent: May 19, 2015

(54) VARIABLE GEOMETRY VANE SYSTEM FOR GAS TURBINE ENGINES

(75) Inventors: Brian Peck, Plainfield, IN (US); Edward Claude Rice, Indianapolis, IN (US)

(73) Assignees: Rolls-Royce Corporation, Indianapolis, IN (US); Rolls-Royce North American Technologies, Inc., Indianapolis, IN (US)

( * ) Notice: Subject to any disclaimer, the term of this patent is extended or adjusted under 35 U.S.C. 154(b) by 691 days.

(21) Appl. No.: 13/339,047

(22) Filed: Dec. 28, 2011

(65) Prior Publication Data

US 2012/0171020 A1 Jul. 5, 2012

Related U.S. Application Data

(60) Provisional application No. 61/428,631, filed on Dec. 30, 2010.

(51) Int. Cl.

| | |
|---|---|
| ***F01D 17/16*** | (2006.01) |
| ***F04D 29/46*** | (2006.01) |
| ***F04D 29/56*** | (2006.01) |

(52) U.S. Cl.

CPC ..... *F01D 17/162* (2013.01); *F01D 17/165* (2013.01); *F04D 29/462* (2013.01); *F04D 29/563* (2013.01)

(58) Field of Classification Search

CPC ..... F01D 17/14; F01D 17/16; F01D 17/162; F04D 29/563

USPC ..... 415/118, 159, 160, 161, 162, 166

See application file for complete search history.

(56) References Cited

U.S. PATENT DOCUMENTS

| | | | | |
|---|---|---|---|---|
| 2,805,818 | A * | 9/1957 | Ferri | 415/148 |
| 3,318,574 | A * | 5/1967 | Tyler | 415/36 |
| 3,963,369 | A | 6/1976 | Balje | |
| 4,300,869 | A | 11/1981 | Swearingen | |
| 4,679,984 | A | 7/1987 | Swihart et al. | |
| 5,620,301 | A | 4/1997 | Lawer | |
| 5,630,701 | A | 5/1997 | Lawer | |
| 6,039,534 | A | 3/2000 | Stoner et al. | |
| 6,554,567 | B2 | 4/2003 | Sishtla | |
| 7,628,579 | B2 | 12/2009 | Giaimo et al. | |
| 7,690,889 | B2 * | 4/2010 | Giaimo et al. | 415/160 |

(Continued)

FOREIGN PATENT DOCUMENTS

| | | |
|---|---|---|
| DE | 23 29 022 | 2/1975 |
| EP | 1 340 894 A2 | 9/2003 |

(Continued)

OTHER PUBLICATIONS

European Search Report, EP 11010282.9, Rolls-Royce Corporation, et al., Apr. 4, 2012.

(Continued)

*Primary Examiner* — Edward Look
*Assistant Examiner* — Jason Davis
(74) *Attorney, Agent, or Firm* — Krieg DeVault LLP

(57) ABSTRACT

One embodiment of the present invention is a unique variable geometry vane system. Another embodiment is a unique gas turbine engine. Other embodiments include apparatuses, systems, devices, hardware, methods, and combinations for gas turbine engines and turbomachinery variable geometry vane systems. Further embodiments, forms, features, aspects, benefits, and advantages of the present application will become apparent from the description and figures provided herewith.

18 Claims, 3 Drawing Sheets

(56) References Cited

U.S. PATENT DOCUMENTS

| | | | |
|---|---|---|---|
| 2003/0026694 | A1 | 2/2003 | Groskreutz et al. |
| 2007/0020090 | A1 | 1/2007 | Giaimo et al. |
| 2007/0020092 | A1 | 1/2007 | Giaimo et al. |
| 2009/0285673 | A1 | 11/2009 | Giaimo et al. |

FOREIGN PATENT DOCUMENTS

| | | | |
|---|---|---|---|
| EP | 1 746 258 | A2 | 1/2007 |
| EP | 1 998 026 | A2 | 12/2008 |
| EP | 2 006 495 | A1 | 12/2008 |
| EP | 2 053 204 | A2 | 4/2009 |
| FR | 1076326 | | 4/1954 |

OTHER PUBLICATIONS

Machine Translation of DE 23 29 022.
Machine Translation of EP 1 998 026.
Machine Translation of EP 2 006 495.
Machine Translation of FR 1,076,326.

* cited by examiner

VARIABLE GEOMETRY VANE SYSTEM FOR GAS TURBINE ENGINES

CROSS REFERENCE TO RELATED APPLICATIONS

The present application claims benefit of U.S. Provisional Patent Application No. 61/428,631, filed Dec. 30, 2010, entitled Variable Geometry Vane System For Gas Turbine Engines, which is incorporated herein by reference.

FIELD OF THE INVENTION

The present invention relates to turbomachinery, and more particularly, to a variable geometry vane system for gas turbine engines.

BACKGROUND

Variable geometry vane systems for gas turbine engines and other turbomachinery systems remain an area of interest. Some existing systems have various shortcomings, drawbacks, and disadvantages relative to certain applications. Accordingly, there remains a need for further contributions in this area of technology.

SUMMARY

One embodiment of the present invention is a unique variable geometry vane system. Another embodiment is a unique gas turbine engine. Other embodiments include apparatuses, systems, devices, hardware, methods, and combinations for gas turbine engines and turbomachinery variable geometry vane systems. Further embodiments, forms, features, aspects, benefits, and advantages of the present application will become apparent from the description and figures provided herewith.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
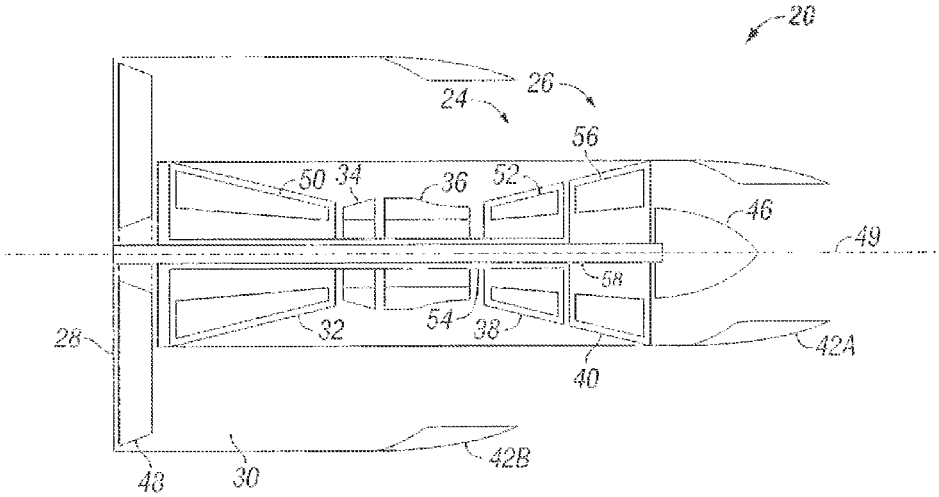
FIG. 1 schematically illustrates some aspects of a non-limiting example of a gas turbine engine in accordance with an embodiment of the present invention.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

Referring to the drawings, and in particular FIG. 1, there are illustrated some aspects of a non-limiting example of a gas turbine engine 20 in accordance with an embodiment of the present invention. In one form, engine 20 is a propulsion engine, e.g., an aircraft propulsion engine. In other embodiments, engine 20 may be any other type of gas turbine engine, e.g., a marine gas turbine engine, an industrial gas turbine engine, or any aero, aero-derivative or non-aero gas turbine engine. In one form, engine 20 is a two spool engine having a high pressure (HP) spool 24 and a low pressure (LP) spool 26. In other embodiments, engine 20 may include three or more spools, e.g., may include an intermediate pressure (IP) spool and/or other spools. In one form, engine 20 is a turbofan engine, wherein LP spool 26 is operative to drive a propulsor 28 in the form of a turbofan (fan) system, which may be referred to as a turbofan, a fan or a fan system. In other embodiments, engine 20 may be a turboprop engine, wherein LP spool 26 powers a propulsor 28 in the form of a propeller system (not shown), e.g., via a reduction gearbox (not shown). In yet other embodiments, LP spool 26 powers a propulsor 28 in the form of a propfan. In still other embodiments, propulsor 28 may take other forms, such as one or more helicopter rotors or tilt-wing aircraft rotors.

In one form, engine 20 includes, in addition to fan 28, a bypass duct 30, a compressor 32, a diffuser 34, a combustor 36, a high pressure (HP) turbine 38, a low pressure (LP) turbine 40, a nozzle 42A, a nozzle 42B, and a tailcone 46, which are generally disposed about and/or rotate about an engine centerline 49. In other embodiments, there may be, for example, an intermediate pressure spool having an intermediate pressure turbine. In one form, engine centerline 49 is the axis of rotation of fan 28, compressor 32, turbine 38 and turbine 40. In other embodiments, one or more of fan 28, compressor 32, turbine 38 and turbine 40 may rotate about a different axis of rotation.

In the depicted embodiment, engine 20 core flow is discharged through nozzle 42A, and the bypass flow is discharged through nozzle 42B. In other embodiments, other nozzle arrangements may be employed, e.g., a common nozzle for core and bypass flow; a nozzle for core flow, but no nozzle for bypass flow; or another nozzle arrangement. Bypass duct 30 and compressor 32 are in fluid communication with fan 28. Nozzle 42B is in fluid communication with bypass duct 30. Diffuser 34 is in fluid communication with compressor 32. Combustor 36 is fluidly disposed between compressor 32 and turbine 38. Turbine 40 is fluidly disposed between compressor 32 and turbine 38. Turbine 40 is fluidly disposed between turbine 38 and nozzle 42A. In one form, combustor 36 includes a combustion liner that contains a continuous combustion process. In other embodiments, combustor 36 may take other forms, and may be, for example, a wave rotor combustion system, a rotary valve combustion system, a pulse detonation combustion system or a slinger combustion system, and may employ deflagration and/or detonation combustion processes.

Fan system 28 includes a fan rotor system 48 driven by LP spool 26. In various embodiments, fan rotor system 48 may include one or more rotors (not shown) that are powered by turbine 40. In various embodiments, fan 28 may include one or more fan vane stages (not shown in FIG. 1) that cooperate with fan blades (not shown) of fan rotor system 48 to compress air and to generate a thrust-producing flow. Bypass duct 30 is operative to transmit a bypass flow generated by fan 28 around the core of engine 20. Compressor 32 includes a compressor rotor system 50. In various embodiments, compressor rotor system 50 includes one or more rotors (not shown) that are powered by turbine 38. Compressor 32 also includes a plurality of compressor vane stages (not shown in FIG. 1) that cooperate with compressor blades (not shown) of compressor rotor system 50 to compress air. In various embodiments, the compressor vane stages may include a compressor discharge vane stage and/or a diffuser vane stage.

Turbine 38 includes a turbine rotor system 52. In various embodiments, turbine rotor system 52 includes one or more rotors (not shown) operative to drive compressor rotor system 50. Turbine 38 also includes a plurality of turbine vane stages (not shown in FIG. 1) that cooperate with turbine blades (not shown) of turbine rotor system 52 to extract power from the hot gases discharged by combustor 36. Turbine rotor system 52 is drivingly coupled to compressor rotor system 50 via a shafting system 54. Turbine 40 includes a turbine rotor system 56. In various embodiments, turbine rotor system 56 includes one or more rotors (not shown) operative to drive fan rotor system 48. Turbine 40 also includes a plurality of turbine vane stages (not shown in FIG. 1) that cooperate with turbine blades (not shown) of turbine rotor system 56 to extract power from the hot gases discharged by turbine 38. Turbine rotor system 56 is drivingly coupled to fan rotor system 48 via a shafting system 58. In various embodiments, shafting systems 54 and 58 include a plurality of shafts that may rotate at the same or different speeds and directions for driving fan rotor system 48 rotor(s) and compressor rotor system 50 rotor(s). In some embodiments, only a single shaft may be employed in one or both of shafting systems 54 and 58. Turbine 40 is operative to discharge the engine 20 core flow to nozzle 42A.

During normal operation of gas turbine engine 20, air is drawn into the inlet of fan 28 and pressurized by fan rotor 48. Some of the air pressurized by fan rotor 48 is directed into compressor 32 as core flow, and some of the pressurized air is directed into bypass duct 30 as bypass flow. Compressor 32 further pressurizes the portion of the air received therein from fan 28, which is then discharged into diffuser 34. Diffuser 34 reduces the velocity of the pressurized air, and directs the diffused core airflow into combustor 36. Fuel is mixed with the pressurized air in combustor 36, which is then combusted. The hot gases exiting combustor 36 are directed into turbines 38 and 40, which extract energy in the form of mechanical shaft power to drive compressor 32 and fan 28 via respective shafting systems 54 and 58. The hot gases exiting turbine 40 are discharged through nozzle system 42A, and provide a component of the thrust output by engine 20.

Figure 2A:
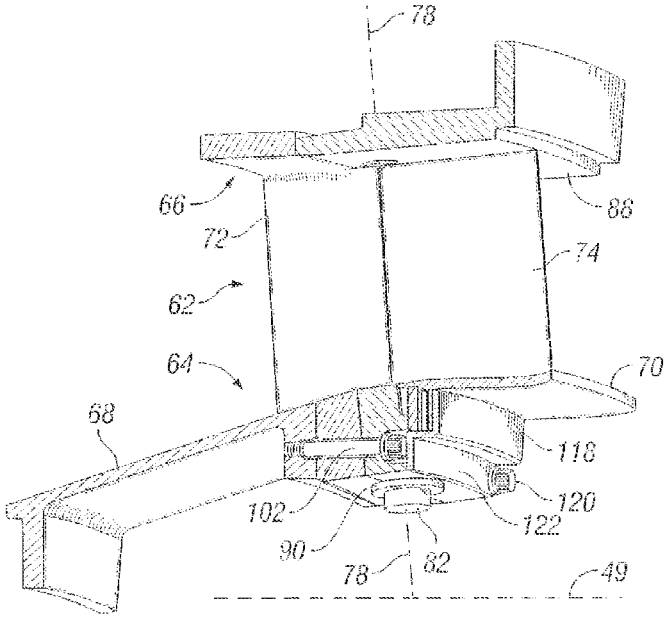
FIG. 2A illustrates a perspective view of some aspects of a non-limiting example of a portion of a variable geometry vane system in accordance with an embodiment of the present invention, showing one variable geometry vane of a plurality of variable geometry vanes of the variable geometry vane system.
Figure 2B:
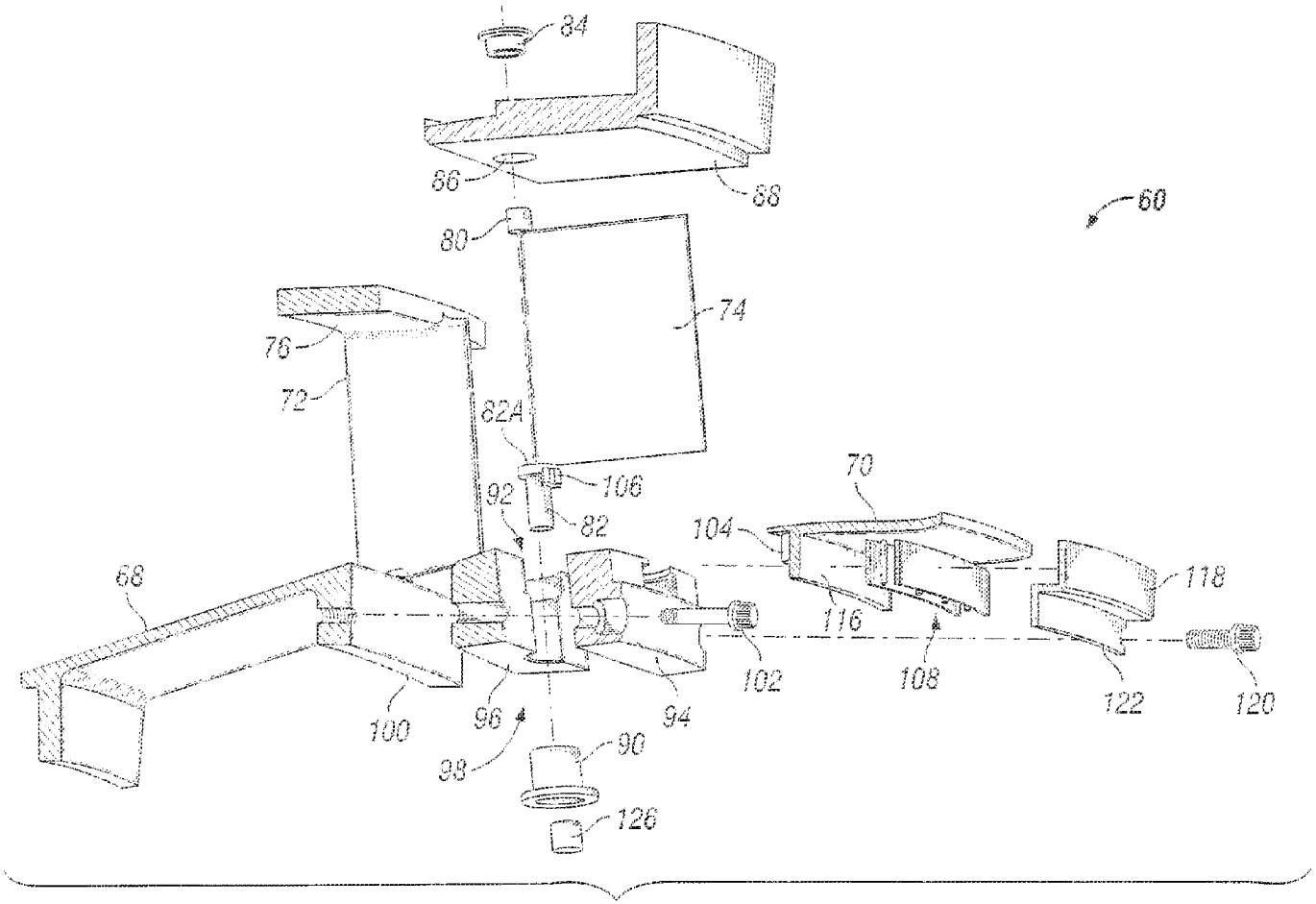
FIG. 2B is an exploded view illustrating some aspects of a non-limiting example of the variable geometry vane system of FIG. 2A in accordance with an embodiment of the present invention.

Referring now to FIGS. 2A and 2B, some aspects of a non-limiting example of a variable geometry vane system 60 in accordance with an embodiment of the present invention is illustrated. In one form, variable geometry vane system 60 is a variable geometry compressor vane system. In other embodiments, variable geometry vane system 60 may be a variable geometry fan vane system or a variable geometry turbine vane system. In various embodiments, engine 20 may include instances of variable geometry vane system 60 adapted for use in one or more of fan 28, compressor 32, turbine 38 and/or turbine 40. In still other embodiments, variable geometry vane system 60 may be employed in other types of turbomachines, e.g., including turbopumps or other types of turbomachinery that employs vanes and employ components which rotate about the turbomachine's axis of rotation.

Variable geometry vane system 60 includes a plurality of variable vanes 62 disposed between an inner flowpath wall 64 and an outer flowpath wall 66. A flowpath wall is a structure that establishes a boundary for core flow or bypass flow in a turbomachine, such as a gas turbine engine. In an axial flow machine, flowpath walls bound the flow in the radial direction, forcing the flow into a generally axial direction, which may or may not include radial direction components, depending upon the particular engine configuration. In one form, inner flowpath wall 64 includes a fixed inner flowpath wall portion 68 and a rotatable flowpath wall portion 70, each of which extend circumferentially around centerline 49 to form rings that are centered about centerline 49. In other embodiments, rotatable flowpath wall portion 70 may be an outer flowpath wall, e.g., centered about centerline 49. Rotatable flowpath wall portion 70 is configured to rotate about the compressor 32 axis of rotation, which in the present embodiment is centerline 49. Rotatable flowpath wall portion 70 is configured to function as an integral flowpath wall/synchronization ring to synchronize the rotation of vanes 62 about respective vane axes of rotation (discussed below). In other embodiments, one or more portions of outer flowpath wall 66 may be configured as rotatable flowpath wall/synchronization ring in addition to or in place of rotatable flowpath wall portion 70.

In one form, each vane 62 is split into a fixed vane leading edge portion 72 and a rotatable vane trailing edge portion 74. Fixed vane leading edge portion 72 extends radially inward from a forward flowpath wall portion 76 of outer flowpath wall 66 to fixed inner flowpath wall portion 68. Trailing edge portion 74 is configured to rotate (pivot) about a vane axis of rotation 78. In other embodiments, vane 62 may take other forms, including without limitation, a rotatable leading edge portion with a fixed or rotatable trailing edge portion; or may be formed of three or more components, e.g., a leading edge portion, a central portion and a trailing edge portion, wherein the central portion is fixed, and the leading edge portion and trailing edge portion are rotatable. The rotation of one or more portions of vanes 62 may be accomplished via one or more types of mechanisms, for example and without limitation, those described herein.

Rotatable vane trailing edge portion 74 includes a tip pivot shaft 80 and a root pivot shaft 82. In one form, pivot shafts 80 and 82 are integral with trailing edge portion 74. In other embodiments, one or both of pivot shafts 80 and 82 may be otherwise coupled to or affixed to trailing edge portion 74. Pivot shaft 80 is received into and piloted by a bushing 84. Bushing 84 is received into an opening 86 of an aftward flowpath wall portion 88 of outer flowpath wall 66. Pivot shaft 82 is received into and piloted by a bushing 90. Bushing 90 is received into an opening 92 formed by sides 94 and 96 of a split inner ring 98. Sides 94 and 96 of split inner ring 98 are clamped together and secured to a flange 100 extending from fixed inner flowpath wall portion 68 by a plurality of bolts 102 spaced apart circumferentially around split inner ring 98. The locations and dimensions of openings 86 and 92, bushings 84 and 90 and pivot shafts 80 and 82 form the axis of rotation 78 for each vane 62.

Rotatable flowpath wall portion 70 includes a driving member 104. Rotatable vane trailing edge portion 74 includes a driven member 106, that when rotated, imparts rotation to rotatable vane trailing edge portion 74 about axis of rotation 78. Driving member 104 is configured to engage driven member 106 and to impart rotation to driven member 106 upon a rotation of flowpath wall portion 70 about centerline 49. In one form, driving member 104 is formed integrally with flowpath wall portion 70. In other embodiments, driving member 104 may be formed separately and may be coupled or affixed to flowpath wall portion 70. In one form, driving member 104 extends circumferentially along flowpath wall portion 70. In a particular form, driving member 104 extends continuously along flowpath wall portion 70. In other embodiments, driving member 104 may be subdivided into a plurality of portions, which in some embodiments may be spaced apart circumferentially along flowpath wall portion 70.

In one form, driving member 104 is a gear having a plurality of teeth, e.g., a circumferential rack gear, and driven member 106 is a gear having a plurality of teeth, e.g., a pinion gear, that is in mesh with driving member 104. In other embodiments, driving member 104 and driven member 106 may take other forms, e.g., metallic and/or composite belt drives, bell-crank drives or other suitable mechanical drive types. In one form, driven member 106 is formed integrally with rotatable vane trailing edge portion 74, e.g., as part of pivot shaft 82. In a particular form, driven member 106 extends from a larger diameter portion 82A of pivot shaft 82. In other embodiments, driven member may be formed separately and coupled or affixed to trailing edge portion 74 and/or pivot shaft 82.

Figure 3:
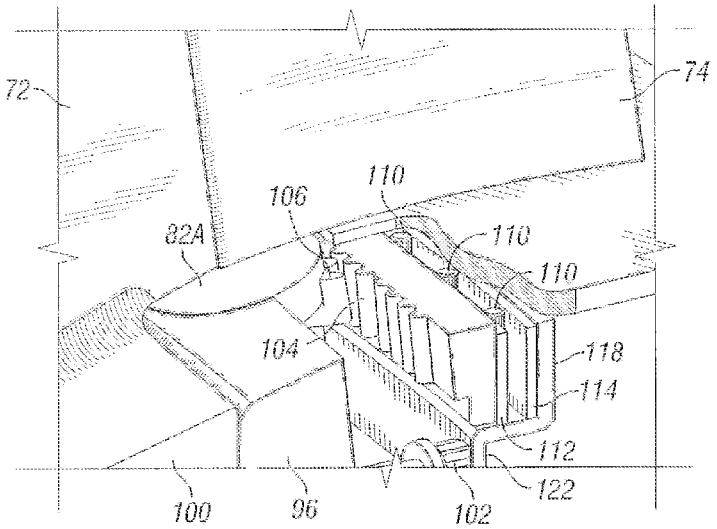
FIG. 3 is a perspective view of some aspects of a non-limiting example of the variable geometry vane system of FIG. 2A in accordance with an embodiment of the present invention.

Referring to FIG. 3 in conjunction with FIGS. 2A and 2B, driving member 104 is retained in engagement with driven member 106 via a bearing 108. For clarity of illustration, side 94 of split inner ring 118 is not shown in FIG. 3. In one form, bearing 108 is a rolling element bearing having a plurality of rolling elements 110 disposed between a forward race 112 and an aft race 114 and spaced apart circumferentially around bearing 108. In other embodiments, bearing 108 may be one or more bearing surfaces that do not include rolling elements. Bearing 108 is retained in engagement with an aft face 116 of flowpath wall portion 70 by a retaining ring 118, which is secured to side 94 of split inner ring 98 via a plurality of bolts 120 spaced apart circumferentially around retaining ring 118. In particular, bolts 120 secure a lower lip 122 of retaining ring 118 to side 94 of split inner ring 98. Lower lip 122 is disposed radially inward of bearing 108 and driving member 104.

Figure 4:
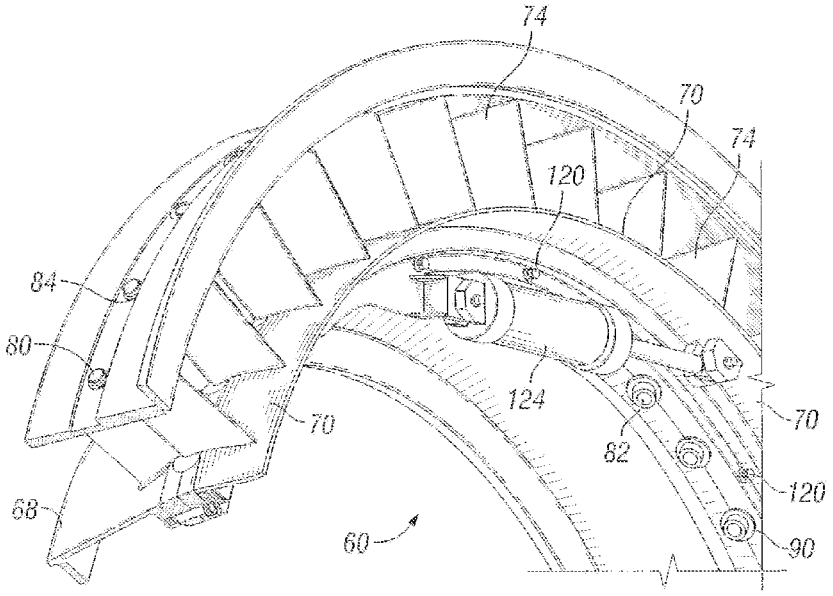
FIG. 4 is a perspective view of some aspects of a non-limiting example of the variable geometry vane system of FIG. 2A in accordance with an embodiment of the present invention.

Referring to FIG. 4 in conjunction with FIGS. 2A, 2B and 3, an actuator 124 is coupled between static structure, e.g., retaining ring 118, and rotatable flowpath wall portion 70. In one form, a linear actuator is employed. In other embodiments, actuator 124 may take one or more other forms. Actuator 124 is configured to impart rotation to flowpath wall portion 70 about centerline 49, which transmits rotation to trailing edge portion 74 via driving member 104 and driven member 106. Thus, variable geometry vane system 60 is configured to rotate at least part of each vane 62 (e.g., trailing edge portion 74) about its vane axis of rotation 78 with a rotation of the flowpath wall portion 70 about centerline 49. The rotation of trailing edge portion 74 of vane 62 provides variable geometry to vane 62. In some embodiments, a sensor 126 configured to sense an amount of the rotation of trailing edge portion 74 about vane axis of rotation 78 may be attached to one or more portions of trailing edge portion 74 or other component(s) that rotate with trailing edge portion 74. The output of sensor 126 may be employed by a control systems, such as an engine control system, to aid in rotating trailing edge portion 74 to a desired degree. In one form, sensor 126 is an RVDT (rotary variable differential transformer). In other embodiments, other sensor types may be employed to detect the amount of rotation of trailing edge portion 74.

Embodiments of the present invention include a variable geometry vane system for a vane stage of a turbomachine, comprising; a plurality of vanes, wherein each vane has a vane axis of rotation and is configured to rotate, at least in part, about the vane axis of rotation; and wherein each vane has a driven member configured, that when rotated, to impart rotation of at least part of the vane about the vane axis of rotation; and a flowpath wall configured to rotate about an axis of rotation of the turbomachine, wherein the flowpath wall has a driving member configured to engage the driven member and configured to impart rotation to the driven member upon rotation of the flowpath wall about a turbomachine axis of rotation.

In a refinement, the driving member is a first gear; and wherein the driven member is a second gear in mesh with the first gear.

In another refinement, the second gear extends circumferentially along the flowpath wall.

In yet another refinement, the flowpath wall forms an integral synchronization ring configured to synchronize the rotation of the plurality of vanes.

In still another refinement, the driving member is coupled to the synchronization ring.

In yet still another refinement, the flowpath wall is an inner flowpath wall.

In an additional refinement, the flowpath wall extends circumferentially about the turbomachine axis of rotation.

In a further refinement, wherein the flowpath wall forms a ring centered about the turbomachine axis of rotation.

In a yet further refinement, each vane includes a pivot shaft; and wherein the driven member is formed integrally with the pivot shaft.

In a still further refinement, the driven member is formed integrally with at least a part of each vane.

Embodiments of the present invention include a gas turbine engine, comprising: a fan having a fan axis of rotation; a compressor in fluid communication with the fan and having a compressor axis of rotation; a combustor in fluid communication with the compressor; a turbine in fluid communication with the combustor and having a turbine axis of rotation; and a variable geometry vane system, including: a plurality of vanes, wherein each vane has a vane axis of rotation and is configured to rotate, at least in part, about the vane axis of rotation; a flowpath wall configured to rotate about the fan and/or the compressor and/or turbine axis of rotation, wherein the variable geometry vane system is configured to rotate at least part of each vane about the vane axis of rotation with a rotation of the flowpath wall about the fan, compressor and/or the turbine axis of rotation.

In a refinement, each vane has a driven member configured, that when rotated, to impart rotation to at least part of the vane about the vane axis of rotation; wherein the flowpath wall has a driving member configured to engage the driven member and configured to impart rotation to the driven member upon rotation of the flowpath wall about the fan, compressor and/or turbine axis of rotation.

In another refinement, the driving member is integral with the flowpath wall.

In yet another refinement, the driven member of each vane is integral with the each vane.

In still another refinement, the gas turbine engine further comprises an actuator configured to impart rotation to the flowpath wall about the fan, compressor and/or the turbine axis of rotation.

In yet still another refinement, the gas turbine engine further comprises a sensor configured to sense an amount of the rotation of at least part of at least one vane about the vane axis of rotation.

In a further refinement, the sensor is a rotary variable differential transformer.

In a yet further refinement, each vane has a leading edge and a trailing edge portion, and wherein the trailing edge portion is configured to rotate about the vane axis of rotation.

In a still further refinement, the leading edge portion is stationary and not configured to rotate about the vane axis of rotation.

Embodiments of the present invention include a gas turbine engine, comprising: a fan having a fan axis of rotation; a compressor in fluid communication with the fan and having a compressor axis of rotation; a combustor in fluid communication with the compressor; a turbine in fluid communication with the combustor and having a turbine axis of rotation; and a variable geometry vane system, including: a plurality of vanes, wherein each vane has a vane axis of rotation and is configured to rotate, at least in part, about the vane axis of rotation; and means for rotating at least a part of each vane about its vane axis of rotation.

In a refinement, the means for rotating includes a flowpath wall configured to rotate about the fan, compressor and/or turbine axis of rotation.

In another refinement, the flowpath wall forms an integral synchronization ring configured to synchronize the rotation of the plurality of vanes.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A variable geometry vane system for a vane stage of a turbomachine, comprising;

a plurality of vanes, wherein each vane has a vane axis of rotation and is configured to rotate, at least in part, about the vane axis of rotation; and wherein each vane has a driven member configured, that when rotated, to impart rotation of at least part of the vane about the vane axis of rotation; and a flowpath wall configured to rotate about an axis of rotation of the turbomachine, wherein the flowpath wall has a driving member configured to engage the driven member and configured to impart rotation to the driven member upon rotation of the flowpath wall about a turbomachine axis of rotation, wherein the driving member is a gear, and wherein the driven member is a gear.

2. The variable geometry vane system of claim 1, wherein the driving member is a first gear; and wherein the driven member is a second gear in mesh with the first gear.

3. The variable geometry vane system of claim 2, wherein the second gear extends circumferentially along the flowpath wall.

4. The variable geometry vane system of claim 1, wherein the flowpath wall forms an integral synchronization ring configured to synchronize the rotation of the plurality of vanes.

5. The variable geometry vane system of claim 4, wherein the driving member is coupled to the synchronization ring.

6. The variable geometry vane system of claim 1, wherein the flowpath wall is an inner flowpath wall.

7. The variable geometry vane system of claim 1, wherein the flowpath wall extends circumferentially about the turbomachine axis of rotation.

8. The variable geometry vane system of claim 7, wherein the flowpath wall forms a ring centered about the turbomachine axis of rotation.

9. The variable geometry vane system of claim 1, wherein each vane includes a pivot shaft; and wherein the driven member is formed integrally with the pivot shaft.

10. The variable geometry vane system of claim 1, wherein the driven member is formed integrally with at least a part of each vane.

11. A gas turbine engine, comprising:

a fan having a fan axis of rotation;

a compressor in fluid communication with the fan and having a compressor axis of rotation;

a combustor in fluid communication with the compressor;

a turbine in fluid communication with the combustor and having a turbine axis of rotation; and a variable geometry vane system, including: a plurality of vanes, wherein each vane has a vane axis of rotation that is substantially perpendicular to the fan, compressor and/or the turbine axis of rotation, and wherein each vane has a driven gear member that is configured to rotate, at least in part, about the vane axis of rotation; a flowpath wall configured to rotate about the fan and/or the compressor and/or turbine axis of rotation, the flowpath wall having a driving gear member configured to engage the driven gear member of each vane, wherein the variable geometry vane system is configured to rotate at least part of each vane about the vane axis of rotation with a rotation of the flowpath wall about the fan, compressor and/or the turbine axis of rotation when the driving gear member drives the driven gear member.

12. The gas turbine engine of claim 11, wherein the driving member is integral with the flowpath wall.

13. The gas turbine engine of claim 11, wherein the driven member of each vane is integral with the each vane.

14. The gas turbine engine of claim 11, further comprising an actuator configured to impart rotation to the flowpath wall about the fan, compressor and/or the turbine axis of rotation.

15. The gas turbine engine of claim 11, further comprising a sensor configured to sense an amount of the rotation of at least part of at least one vane about the vane axis of rotation.

16. The gas turbine engine of claim 15, wherein the sensor is a rotary variable differential transformer.

17. The gas turbine engine of claim 11, wherein each vane has a leading edge and a trailing edge portion, and wherein the trailing edge portion is configured to rotate about the vane axis of rotation.

18. The gas turbine engine of claim 11, wherein a leading edge portion of each vane is stationary and not configured to rotate about the vane axis of rotation.

* * * * *